US007134585B2

(12) United States Patent
Schiestl et al.

(10) Patent No.: US 7,134,585 B2
(45) Date of Patent: Nov. 14, 2006

(54) COMBUSTION-POWERED SETTING DEVICE

(75) Inventors: Ulrich Schiestl, Feldkirch (AT); Hans Gschwend, Buchs (CH); Peter Hertlein, Gams (CH); Ulrich Rosenbaum, Wangs (CH); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/864,848

(22) Filed: Jun. 9, 2004

(65) Prior Publication Data

US 2004/0251296 A1 Dec. 16, 2004

(30) Foreign Application Priority Data

Jun. 12, 2003 (DE) ..... 103 26 473

(51) Int. Cl.
*B25C 1/08* (2006.01)
*B25C 1/18* (2006.01)

(52) U.S. Cl. ..... 227/9; 227/10; 227/11; 123/46 SC

(58) Field of Classification Search ..... 227/8, 227/9, 10, 11, 201; 123/46 SC
See application file for complete search history.

(56) References Cited

U.S. PATENT DOCUMENTS 4,483,474 A * 11/1984 Nikolich ..... 227/8
4,522,162 A * 6/1985 Nikolich ..... 123/46 SC
5,213,247 A * 5/1993 Gschwend et al. ..... 227/10
5,909,836 A * 6/1999 Shkolnikov et al. ..... 227/8
6,102,270 A * 8/2000 Robinson ..... 227/10
6,145,724 A * 11/2000 Shkolnikov et al. ..... 227/8
6,425,354 B1 * 7/2002 Buchel et al. ..... 123/46 R

* cited by examiner

*Primary Examiner*—Rinaldi I. Rada
*Assistant Examiner*—Nathaniel Chukwurah
(74) *Attorney, Agent, or Firm*—Abelman, Frayne & Schwab

(57) ABSTRACT

The present invention is directed to a combustion powered setting device for driving fastening elements such as nails, bolts and pins into a receiving material, with a fuel source, and a fuel line (12.1, 12.2) from the fuel source (11) to a combustion chamber (13) and with at least one metering device (20) for fuel which is arranged in the fuel line (12.1, 12.2) between the fuel source and the combustion chamber. In order to improve setting devices of this type, the metering device (20) has an adjusting device (30) for the metered volume, which adjusting device (30) responds to the fuel pressure.

9 Claims, 4 Drawing Sheets

COMBUSTION-POWERED SETTING DEVICE

BACKGROUND OF THE INVENTION

The present invention is directed to a combustion-powered setting device for driving fastening elements such as nails, bolts and pins, into a receiving material. Setting devices of this kind can be powered by gaseous or liquid fuels that are burned in a combustion chamber and, in so doing, drive a piston for inserting fastening elements.

Generally, metering a balanced amount of fuel to a corresponding amount of air or oxygen, which is used as an oxidizing agent, for each work cycle constitutes a problem. In particular, the air which is drawn from the environment is subject to variations in pressure and temperature which can unfavorably affect the combustion of the air-fuel mixture when this mixture is too rich or too poor with respect to the fuel.

EP 0 597 241B1 discloses a combustion-powered setting device in which the metering of the fuel from the fuel source to the combustion chamber is carried out through a valve which is excitable by means of a solenoid and which is normally closed. Excitation is carried out electronically by means of a switching circuit which responds to the closing of a switch and which opens the valve for a controllable, predetermined time interval so as to enable the liquid fuel to flow from the fuel source to the combustion chamber. However, this is disadvantageous in that the flow velocity of the fuel decreases when the pressure decreases in the fuel source resulting in a discrepancy between the amount of fuel actually metered and the desired amount of fuel. This lowers the performance of the setting device.

Further, DE 42 43 617 A1 discloses a combustion-powered setting device in which a gas inlet valve is opened mechanically in a work cycle, so that fuel flows from a fuel source into a storage space communicating with the surrounding air. A pressure equilibrium and possibly a temperature equilibrium in relation to the surrounding air can take place through this connection, so that a suitable air-fuel mixture reaches the combustion chamber. The fuel then reaches the combustion chamber at a given time proceeding from this storage space. This is disadvantageous in that a loss of fuel may also occur through the connection with the surrounding air.

DE 40 32 204A1 discloses a setting device in which a piston is arranged in a metering chamber and can press a fuel volume out of the metering chamber into the combustion chamber. The metering stroke of the piston can be adjusted by an adjusting screw which is actuated manually. This is disadvantageous in that the manual adjustment is inconvenient. Further, continued metering of the fuel is carried out via a pressure compensation channel so that a loss of fuel may occur.

SUMMARY OF THE INVENTION

Therefore, it is the object of the present invention to develop a setting device of the type mentioned above which avoids the above-mentioned disadvantages and which makes it possible to carry out setting operations in rapid succession with optimum metering of fuel.

An adjusting device for the metered volume, that is, for the fuel volume to be measured by the metering device for each setting operation is arranged at the metering device and responds to the fuel pressure. Through this step, the fuel pressure which is particularly dependent upon the temperature of the combustion chamber enclosure and, therefore, upon the temperature of the surroundings can be utilized in a simple manner for automatic metering of the fuel in the setting device. In this connection, it is advantageous when the fuel device is not arranged directly at the combustion chamber of the setting device, but rather the fuel enclosure or fuel source is arranged in an area of the setting device at approximately the ambient temperature.

The metering device is formed in a simple manner in that this metering device has a metering chamber and a displacing body, and the travel or stroke of the displacing body, and, therefore, the metered volume or of fuel to be dispensed, can be adjusted by means of the adjusting device.

It is advantageous when the adjusting device comprises a pressure receiving chamber, a pressure-sensitive member projecting into the pressure receiving chamber, an actuating member which is displaceable by the pressure-sensitive member, and a pretensioned spring element which biases the pressure-sensitive member in direction of the pressure receiving chamber. Through this step, a technically simple solution is achieved for realizing an adjusting device for the metering device which can respond to the fuel pressure. The pressure-sensitive member and, therefore, the actuating member are held in a buffered manner by a spring element having a suitable characteristic, so that the actuating member and, therefore, the stop for the displacing piston are automatically displaced depending on the ambient temperature and a suitable amount of fuel is always measured off by the metering device.

The pressure-sensitive member can advantageously be constructed as a piston, the fuel pressure acting on its piston surface. In a variant of the invention which is mechanically simple to convert, the actuating member projects into the stroke path of the displacing body and defines the end point of the stroke path of the displacing body in the displacing direction, that is, it forms a stop. The actuating member is constructed in such a way that it is self-locking at the end point of the stroke path when loaded by the displacing body but is otherwise freely movable., With regard to the timing of the metering process, it is advantageous when the displacing body can be actuated by an actuating member in the step of pressing the setting device against a receiving material in the displacing direction. The actuating member can be mechanical, electronic or electromechanical in nature. In a variant of the setting device that can be affected inexpensively, the actuating member is formed as a contact pressing rod assembly. By means of this purely mechanical actuation of the metering device, a setting device can be provided which requires only a small amount of electrical energy, if any, for operation. It is further advantageous when a flexible or elastic element such as a spring element is interposed between the displacing body and the actuating member. A possible stroke of the contact pressing rod assembly in excess of the maximum possible stroke of the displacing body is buffered by this elastic element or spring element when the setting device is pressed against a receiving material.

It is further advantageous when the metering chamber has an inlet and an outlet, the inlet communicating at least occasionally with the pressure receiving chamber. It is further advantageous when at least one valve device is arranged at the inlet, which valve device allows a flow of fuel into the metering chamber but prevents fuel from flowing out, and when a valve device is arranged at the outlet which enables fuel to flow out of the metering chamber in direction of the combustion chamber but prevents fuel from flowing back to the metering chamber. This step ensures that fuel can flow into the metering chamber only through the inlet and can flow out only through the outlet. Further, this prevents incorrect metering due to returning fuel or an incompletely filled metering chamber.

BRIEF DESCRIPTION OF THE INVENTION

Other advantages and steps of the invention are indicated in the subclaims, the following description and the drawings. An embodiment example of the invention is shown in the drawings.

DETAILED DESCRIPTION OF THE INVENTION

Figure 1:
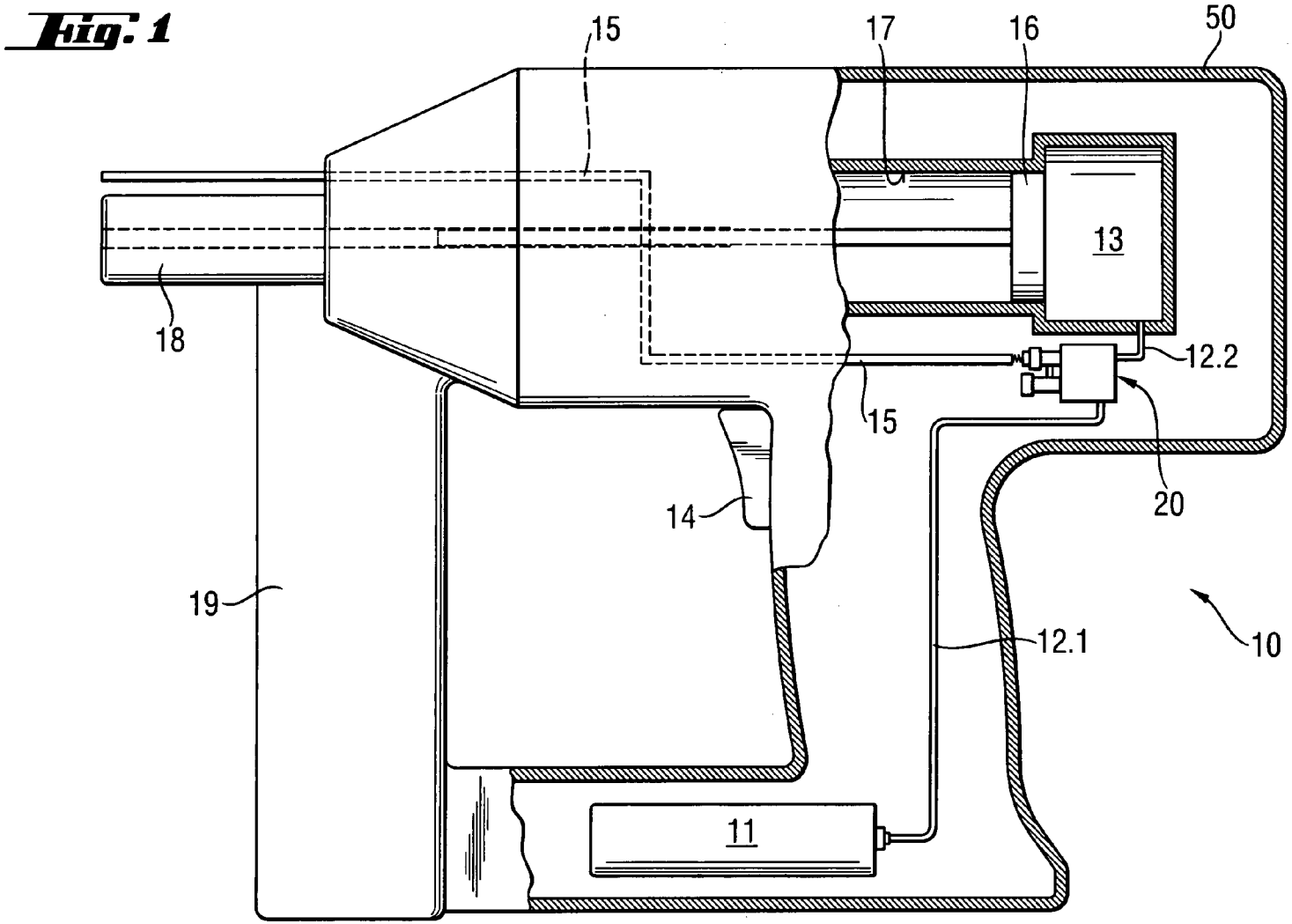
FIG. 1 is a schematic view of a setting device according to the invention in the rest position and in partial cross section.

A setting device 10, according to the invention, powered by combustible gas, is shown in FIG. 1 in its rest position. The setting device 10 has a housing 50 in which is arranged a setting mechanism by which a fastening element, such as a nail, bolt or pin, and the like can be driven into a receiving material, not shown, when the setting device 10 is pressed against a receiving material and is triggered by means of a trigger switch 14. The setting mechanism includes, among others, a combustion chamber 13, a piston guide 17 in which a driving piston 16 is arranged displaceably arranged, and a pin guide 18 in which a fastening element can be guided and driven by the leading end of the driving piston 16 facing in the setting direction and accordingly can be driven into a receiving material. The fastening elements can be stored in a magazine 19 at the setting device 10.

In the present embodiment, example, an ignition unit (not shown), such as a spark plug, is arranged in the combustion chamber 13 for igniting an air-fuel mixture which is introduced into the combustion chamber 13 for a setting operation. The feed of the fuel gas into the combustion space or combustion chamber 13 is effected through a fuel line 12.1, 12.2, 12.3, from a fuel reservoir or fuel source 11.

A metering device, designated in its entirety by 20, is arranged in the fuel line 12.1, 12.2 between the fuel source 11 and the combustion chamber 13. A determined metering volume of fuel is measured by means of this metering device for each setting operation and is supplied to the combustion chamber 13.

Figure 2:
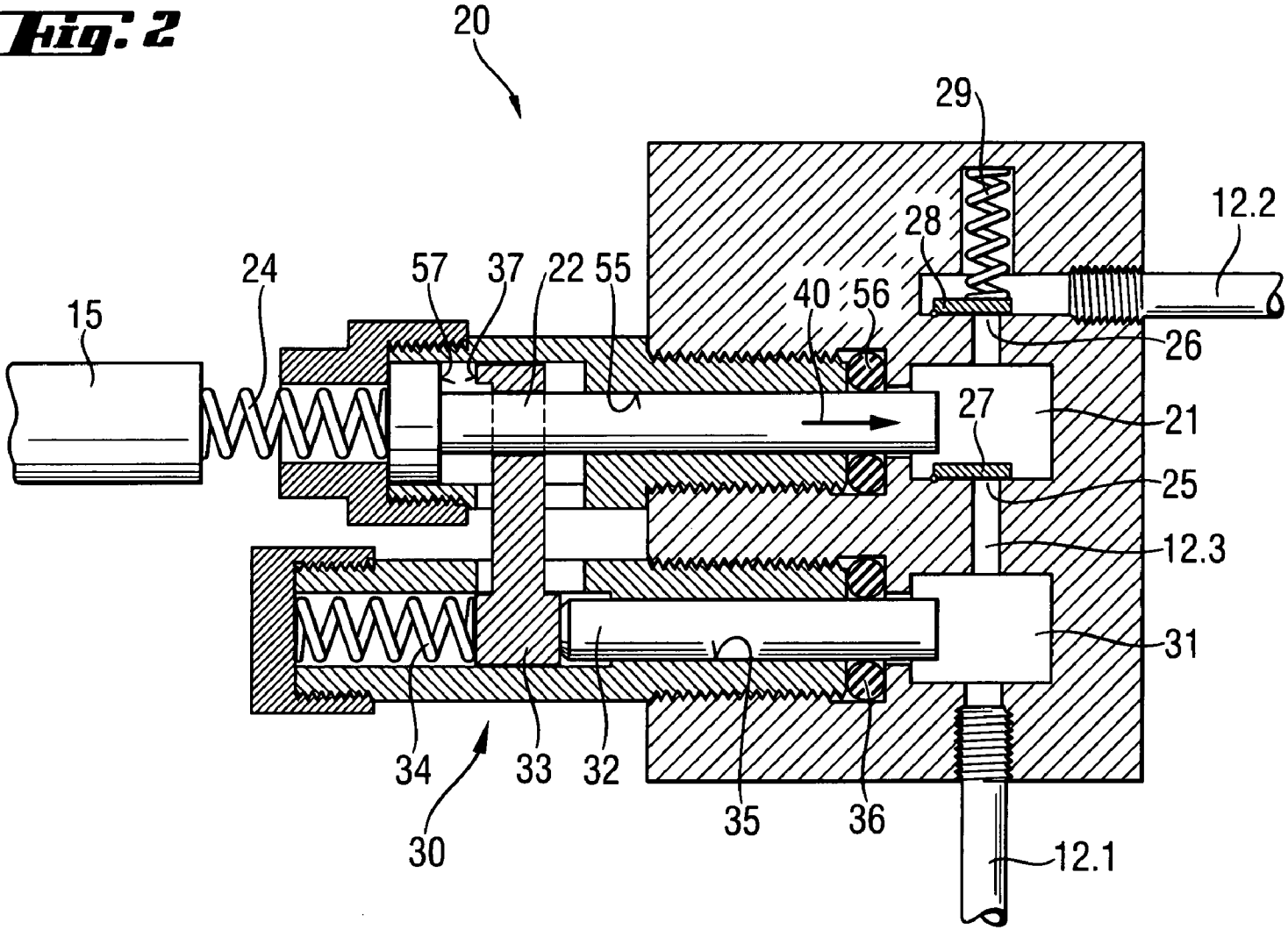
FIG. 2 shows a metering device in the setting device from FIG. 1 in the rest position at a higher temperature of the fuel source.
Figure 3:
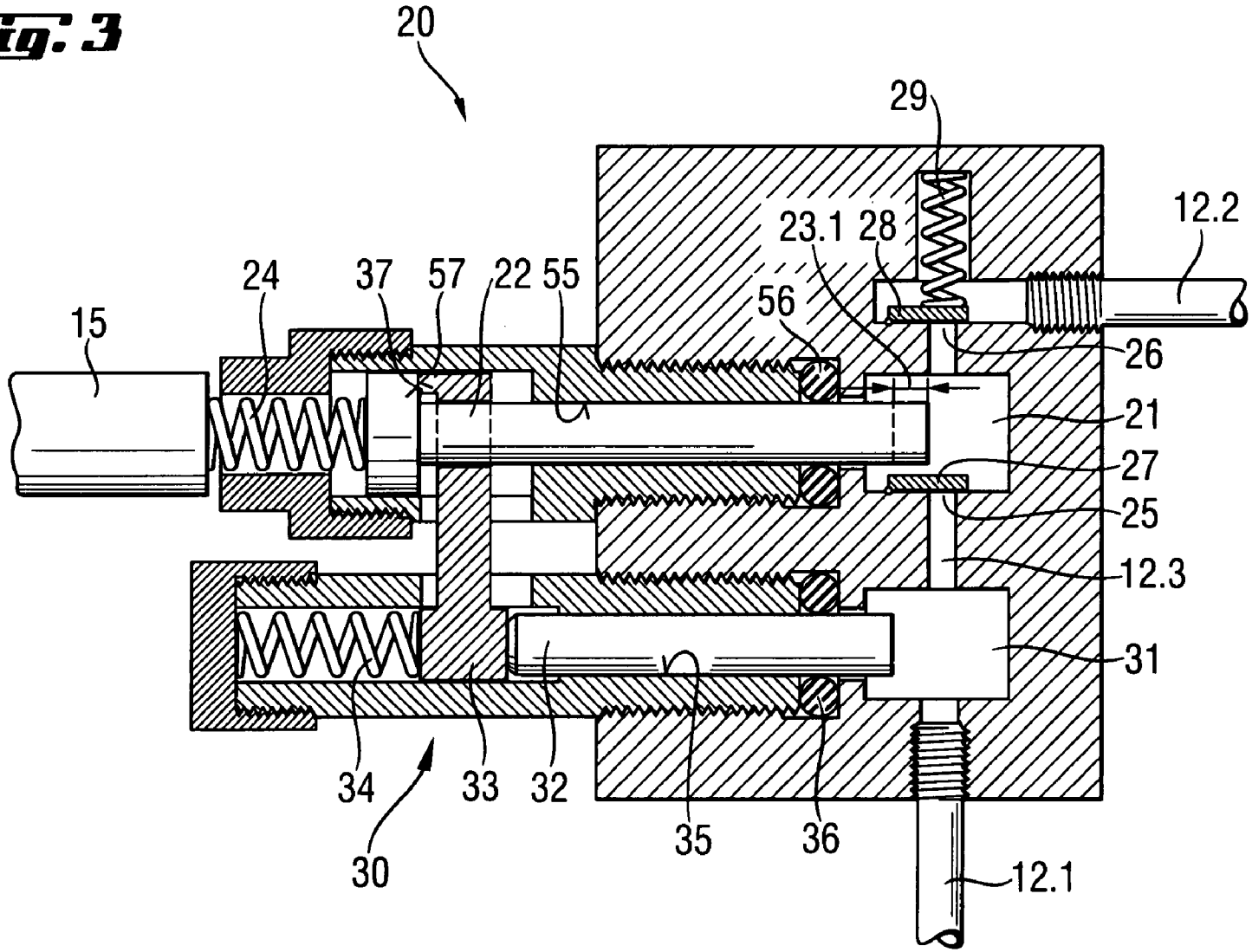
FIG. 3 shows the metering device from FIG. 2 in a position of the setting device in which the latter is pressed against a receiving material.

The metering device 20 is shown in the rest position in FIG. 2 and in the fuel dispensing position (in which the setting device is pressed against a receiving material) in FIG. 3. The fuel and the propellant in the fuel source 11 have a somewhat higher temperature of 25° C. (ambient temperature).

The metering device 20 has a metering chamber 21. A displacing body 22, such as a displacing piston or displacing plunger, is guided lateral to the metering chamber 21 in a guide 55 and can be moved in displacing direction 40 into the metering chamber 21 in order to move a metered volume of fuel from the metering chamber 21 into the fuel line 12.2 and then into the combustion chamber 13 (FIG. 1). An inlet 25 and an outlet 26 for fuel are arranged at the metering chamber 21. A valve device 27, such as a butterfly valve, which makes it possible for fuel to flow out of the fuel source 11 into the metering chamber 21 but which prevents fuel from flowing back in the opposite direction is arranged at the inlet 25. A valve device 28 is likewise arranged at the outlet 26. This valve device 28 allows fuel to flow out of the metering chamber 21 in the direction of the combustion chamber 13 but prevents fuel from flowing out of the combustion chamber 13 to the metering chamber 21. The valve device 28 is constructed in this instance as a butterfly valve which is spring-loaded by a spring element 29 in the closing direction in the manner of a check valve.

Further, an automatic adjusting device 30, for the fuel volume (metered volume) to be dispensed for each setting process is arranged at the metering device 20. The adjusting device 30 has a pressure receiving chamber 31 which constantly communicates with the fuel source 11 via the fuel line 12.1. The pressure receiving chamber 31 communicates with the metering chamber 21 through a fuel line 12.3 or connection channel. A pressure-sensitive member 32 which is constructed in this instance as a piston and is guided in a guide 35 of the adjusting device 30 so as to be displaceable is arranged in the pressure receiving chamber 31. The pressure-sensitive member 32 is under the pressure of fuel or of the propellant applying pressure to the fuel when the fuel source 11 is connected. The force of a spring element 34 acts counter to this pressure at the end of the pressure-sensitive member 32, and the piston, remote of the pressure receiving chamber 31 is supported indirectly by this spring element 34. An actuating member 33 which extends up to the guide 55 of the displacing body 22 is arranged between the pressure-sensitive member 32 and the spring element 34. The end of the actuating member 33 projecting into the guide 55 is ring-shaped and surrounds the displacing body 22. A protuberance 37 which serves as a stop for a projection 57 of the displacing body 22 is arranged at a ring-shaped end of the actuating member 33. The stroke path 23.1, 23.2 of the displacing body 22 (see FIGS. 3 and 4) and accordingly the metering volume of the metering device 20 can be adjusted by means of the position of the actuating member 33 with its protuberance 37.

Sealing elements 36, 56 or O-rings seal the guides 35, 55 with the pressure-sensitive member 32 and the displacing body 22 relative to the pressure receiving chamber 31 and to the metering chamber 21, respectively.

The displacing body 22 is displaced by actuating member 15, such as a mechanical contact displacing line by which a pressing movement of the setting device against a receiving material is transmitted to the displacing body 22. A spring element 24 is positioned between the actuating member 15 and the displacing body 22 and compensates for long pressing paths in relation to short strokes of the piston. It remains to be noted that the displacing body 22 can also be actuated by a driving device operating electrically, magnetically, pneumatically, hydraulically, or in some other manner. The actuation of the displacing body 22 can likewise be carried out after or while the setting device is lifted from a receiving material.

In FIG. 3, the setting device has been pressed against a receiving material and the displacing body 22 has moved into the metering chamber 21 by stroke 23.1 so that a metering volume corresponding to the stroke is fed to the combustion chamber through the fuel line 12.2. The stroke 23.1 of the displacing body 22 was limited by the actuating member 33 which tilts when the projection 57 of the displacing body 22 strikes its protuberance 37 and, in this way, stops the displacing body 22. As was already mentioned, the adjustment of the actuating member 33 is carried out automatically by the pressure of the fuel or of the propellant acting on the latter. This pressure depends on the temperature (particularly the ambient temperature) and accordingly is also a measurement for the density of the surrounding air required for the combustion. Therefore, an ideal air-fuel mixture can always be adjusted automatically. An adjustment of the metering device 20 is possible through selection of the length or the spring force of the spring element 34. An adjusting screw, not shown, can also be provided for changing the pretensioning or bias of the spring element 34.

Figure 4:
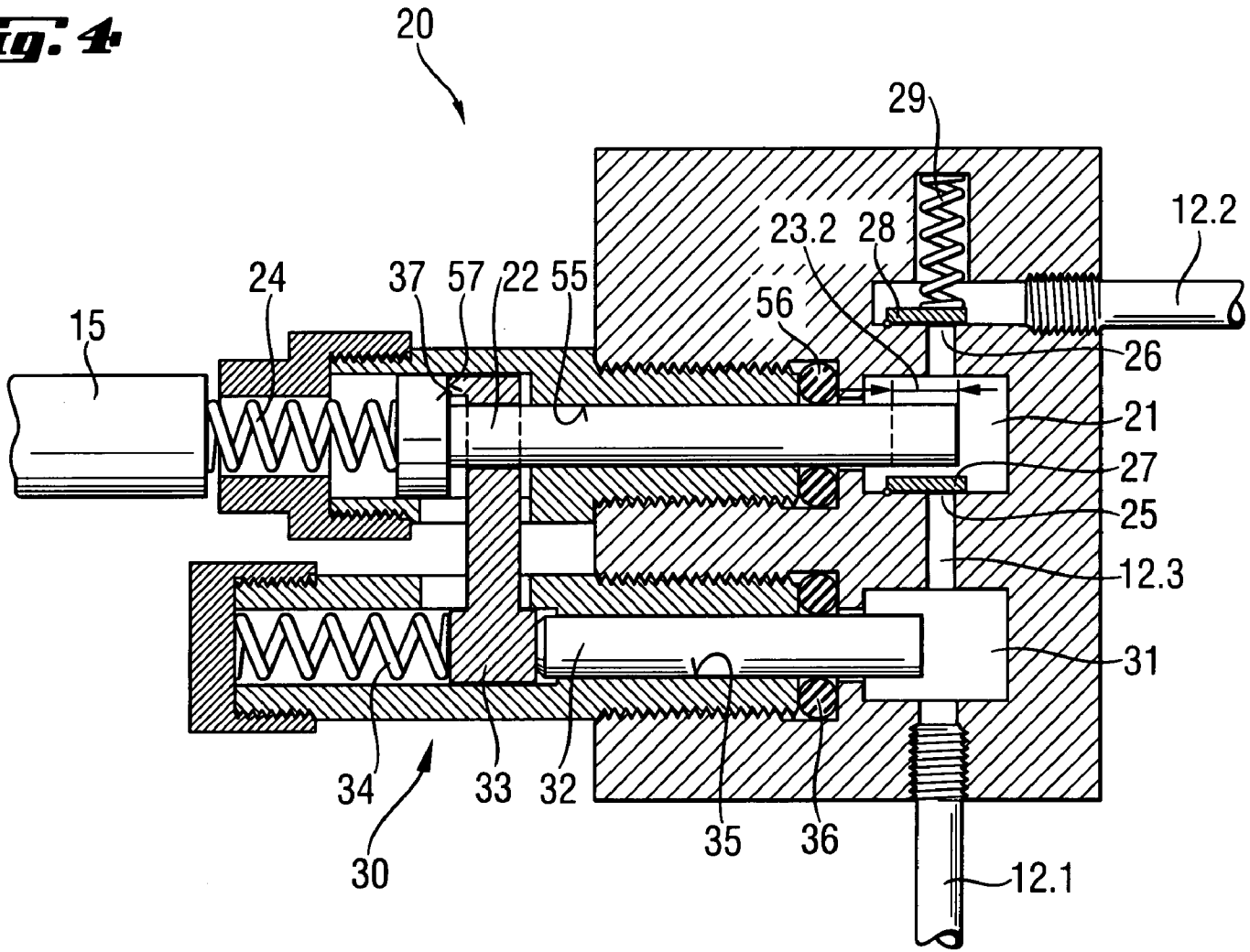
FIG. 4 shows the metering device of the setting device from FIG. 1 in a position of the setting device in which the latter is pressed against a receiving material at a lower temperature of the fuel source.

In FIG. 4, the fuel and the propellant in the fuel source have a somewhat lower temperature of about 5° C. (ambient temperature). The pressure in the fuel source is relatively lower than the assumed pressure of the fuel source in FIGS. 2 and 3. Likewise, the surrounding air has a higher density. Accordingly, more fuel is required for the same volume of air.

As can be seen from FIG. 4, the pressure-sensitive member 32 penetrates farther into the pressure receiving chamber 31 than in FIGS. 2 and 3. The actuating member 33 is accordingly likewise located in a different position so that the displacing body 22 is moved with a greater stroke 23.2 than in FIGS. 2 and 3 when actuated by the actuating member 15 shown in FIG. 4. Accordingly, more fuel is automatically supplied to the combustion chamber.

When the temperature of the setting device and therefore the temperature of the fuel source increase during operation, less fuel is metered into the combustion chamber automatically. Therefore, a balanced air-fuel mixture is always introduced into the combustion chamber when the setting device is operating at a warm temperature.

Of course, the pressure-sensitive member and the displacing body need not necessarily be constructed as a piston or plunger. They could also be formed as diaphragms or as movable chamber walls, for example.

The invention claimed is:

1. Combustion powered setting device for driving fastening elements, such as nails, bolts and pins into receiving material, comprising a fuel source (11), a fuel line (12.1, 12.2) extending from said fuel source (11) to a combustion chamber (13), at least one metering device (20) located in the fuel line (12.1, 12.2) between said fuel source (11) and the combustion chamber (13), an automatic adjusting device (30) in said metering device (20) for providing a metered volume of fuel, and said adjusting device (30) automatically responding to the fuel pressure, wherein said metering device (20) has a metering chamber (21) connected to said feed line (21), a displacing body (22) having a stroke and arranged to be moved into said metering chamber (21) and the stroke of said displacing body (22) is automatically adjustable by said adjusting device (30), and wherein said adjusting device (30) has a pressure receiving chamber (31), a pressure sensitive member (32) extendible into said pressure receiving chamber (31), an actuating member (33) displaceable by said pressure-sensitive member (32), and a pretensioned spring element (34) in contact with said pressure sensitive member (33) biasing said pressure sensitive member (32) into said pressure receiving chamber (31).

2. Setting device, as set forth in claim 1, wherein said pressure sensitive member (32) is formed as a piston.

3. Setting device, as set forth in claim 1, wherein said actuating member (33) projects into a stroke path of said displacing body (22) and defines an end point of the stroke path of said displacing body (22) in a displacing body direction (40).

4. Setting device, as set forth in claim 3, wherein said displacing body (22) can be displaced in the displacing body direction (40) by an actuating member (15) when the setting device is pressed against a receiving material.

5. Setting device, as set forth in claim 4, wherein said actuating member (15) is a pressing rod assembly extending from a housing (50) of the setting device and extending into contact with a receiving material into which a fastening element is to be driven.

6. Setting device, as set forth in claim 4, wherein an elastic element (24) is positioned between said displacing body (22) and said actuating member (15).

7. Setting device, as set forth in claim 6, wherein said elastic element (24) is a spring element.

8. Setting device, as set forth in claim 1, said metering chamber (21) has an inlet (25) and an outlet (26) wherein said inlet (25) communicates at least occasionally with said pressure receiving chamber (31).

9. Setting device, as set forth in claim 8, wherein a first valve device (27) is positioned at said inlet (25) allowing a flow of fuel into said metering chamber (21) and blocking a flow of fuel back out of said inlet, and a second valve device (28) is positioned at said outlet (26) allowing flow out of said metering chamber (21) to said combustion chamber (13) and blocking flow of fuel back into said metering chamber (21).

* * * * *